US006684477B2

(12) United States Patent
Crissey

(10) Patent No.: US 6,684,477 B2
(45) Date of Patent: Feb. 3, 2004

(54) PRESTRESSED CONCRETE FENCE POST ASSEMBLY AND METHOD OF CONSTRUCTION

(75) Inventor: Merrill E. Crissey, Colorado Springs, CO (US)

(73) Assignee: Glenn C. Crissey, Colorado Springs, CO (US)

( * ) Notice: Subject to any disclaimer, the term of this patent is extended or adjusted under 35 U.S.C. 154(b) by 57 days.

(21) Appl. No.: 09/895,708

(22) Filed: Jul. 2, 2001

(65) Prior Publication Data

US 2003/0010969 A1 Jan. 16, 2003

(51) Int. Cl.[7] ..... B21D 39/00
(52) U.S. Cl. ..... 29/452; 256/256.1
(58) Field of Search ..... 29/452, 897.34; 256/256.1, 256.19; 52/223.1; 264/228, 229

(56) References Cited

U.S. PATENT DOCUMENTS 3,903,222 A * 9/1975 Brown, Jr. ..... 264/40.7
4,316,595 A * 2/1982 Wheeler et al. ..... 249/94
6,284,336 B1 * 9/2001 Greene ..... 428/36.91

* cited by examiner

*Primary Examiner*—Gregory Vidovich
*Assistant Examiner*—Stephen Kenny
(74) *Attorney, Agent, or Firm*—Phillip A. Rein

(57) ABSTRACT

A prestressed concrete fence post assembly, including 1) a main fence post body constructed of a high-strength, concrete grout material; 2) a prestressed high-strength steel tendon member positioned centrally and extended longitudinally of the main fence post body; and 3) a plurality of spaced, parallel concentric connector grooves used with wire tie members to secure fence wire strands against outer surfaces of the main fence post body. Forms, equipment, and method steps for economically casting prestressed concrete post assemblies, poles, towers, or the like. A fence post mold assembly consists of two mating fence post mold half sections, each having an inner plastic material liner to form the desired concrete product. Prestressing is accomplished by pretensioning a centrally located high-strength steel tendon member held at each end by anchor jaw assemblies. A hydraulic tensioning apparatus is connected to one of the anchor jaw assemblies and tension is applied to the tendon member. The prestressing force is retained by extending an anchor nut member into engagement with a top end plate member. A high-strength concrete grout material is forced into the fence post mold assembly near a lower base. A factory arrangement involves a plurality of fence post mold assemblies or a carousel molding assembly may be employed to simplify the logistics of manufacture, increasing the production rate, and reducing the number of personnel and factory space required.

16 Claims, 7 Drawing Sheets

SECTION 7–7

SECTION 9–9

SECTION 11–11

SECTION 14–14

PRESTRESSED CONCRETE FENCE POST ASSEMBLY AND METHOD OF CONSTRUCTION

PRIOR ART

A patent search was conducted on this invention and the following United States and foreign patents are noted:

| U.S. Pat. NO. | INVENTION | INVENTOR |
|---|---|---|
| Des. No. 30,959 | FENCE POST | J. W. Brooks |
| 1,372,362 | REINFORCED CONCRETE POLE | Emile Marzoli |
| 1,676,679 | CONCRETE FENCE POST | Wilson Bensinger |
| 3,958,381 | CONCRETE FILLED TAPERED TUBULAR TOWER | Roy E. Meyer |
| 4,008,026 | CONCRETE FORMING APPARATUS FOR MAKING FENCE POSTS AND THE LIKE | William J. Engstrom |
| 4,142,711 | FENCE AND FENCE POST WITH REMOVABLE RAIL RETAINING BRACKET | Rulon W. Brimhall |
| 4,631,883 | TENDONS FOR POST-TENSIONED PRE-STRESSED CONCRETE STRUCTURES | Harris et al |
| 5,630,301 | ANCHORAGE ASSEMBLY AND METHOD FOR POST-TENSIONING IN PRE-STRESSED CONCRETE STRUCTURES | Lyle D. Sieg |
| 5,975,500 | CAST CONCRETE FENCE POSTS AND CAST CONCRETE BASES FOR SAID POSTS | Orton et al |

Additionally, the following foreign patents were found:

| U.S. Pat. NO. | INVENTOR | COUNTRY |
|---|---|---|
| 50,505 | B. H. Sundman | Sweden |
| 609,344 | M. Jean RAS | France |
| 3-81443 | Masahide Tomii | Japan |

The Brooks patent discloses a fence post of a stepped design which is not pertinent to the applicant's invention.

The Marzoli patent discloses a reinforced concrete pole utilizing a central reinforcing bar and wire stands and a mold for constructing same is shown in FIG. 7. No prestressing of the central reinforcing rod is disclosed in this patent. It has a unique shape but not applicable.

The Bensinger patent discloses a concrete fence post which can be screwed into the ground and a wooden strip to support wire fence strands. The tapered concrete post with a tapered bottom with screw threads to aid in getting the post into the ground. No pretensioning is involved.

The Meyer patent discloses a concrete filled tapered tubular tower which may be up to 180 feet in length. However, this post does not have a central reinforcing rod and basically taking an outer steel tower pole or standard 14 and filling it with concrete on location and being filled from a lower inlet port. This achieves a tapered, tubular tower member of considerable strength.

The Engstrom patent discloses a concrete forming apparatus for making fence posts utilizing a batch pour operation similar to a conveyor line production process. A U-shaped reinforcing rod 104 is utilized but no discussion of any prestressing. This patent discloses use of complex and expensive forms.

The Brimhall patent discloses a fence and fence post with removable rail retaining bracket therein teaching square concrete fence posts including a metal rod extended laterally therethrough for attaching to rails 12 and 14 by a cylindrical enclosure 20. This patent teaches a single vertical central reinforcing rod 26 as noted in FIG. 2 but does not set forth any prestressing being involved.

The Harris et al patent discloses tendons for post-tensioned pre-stressed concrete structures having a central reinforcing rod or steel strand 1 that is post-tensioned. This patent teaches the use of an outer sheath 2, a lubricant 3, plus an epoxy resin 11 which would be ruptured on a post-tensioning procedure to create a bond between a surrounding concrete material and the steel strand or reinforcing rod 1. The applicant's post is "pre-tensioned" not "post-tensioned".

The Sieg patent discloses an anchorage assembly and method for post-tensioning in pre-stressed concrete structures and doesn't involve a pre-tensioning step.

The Orton et al patent discloses cast concrete fence posts and cast concrete bases for the posts but no pre-stressing is involved.

The Swedish patent discloses a concrete post having considerable reinforcing rods therein and adapted to be stacked on top of each other to obtain the desired height. There are not any prestressing features involved.

The French patent discloses an elongated tapered pole, which may be a telephone pole, and having reinforcing rods therein in the finished form as noted in FIG. 1A. FIGS. 3, 4, and 5 indicate carousel structures operable to hold and space the reinforcing rods in the proper position and placed within each of the protrusions thereabout.

The Japanese patent discloses a structure for reinforced concrete columns having reinforcing rods 3 therein as noted in FIG. 2 embedded in concrete 2 and having an outer square steel pipe 1 thereabout. The strength is achieved by the positioning of the reinforcement rods 3 and no prestressing is discussed in the brief English description.

BACKGROUND OF THE INVENTION

This invention relates to forms, apparatus, and method procedure steps for mass producing prestressed concrete fence posts, poles, towers, and the like.

The majority of posts used throughout the world are either reinforced concrete, wood, or steel. In earlier times, fence posts were hewn out of sandstone in Kansas where wood is not readily available. The sandstone fence posts are still in wide use in large areas in Central Kansas.

Concrete posts reinforced with deformed non-tensioned re-enforcing bars are now in use, but are larger and heavier than the applicant's prestressed concrete fence post assembly and are more susceptible to cracking.

Steel posts commonly in use are either galvanized tubes or rolled members of T-shape in transverse cross section. Protrusions are provided at intervals to retain fencing, such as barbed wire secured thereto by wire connector ties. Also, U-shaped plates are secured near a base of the steel posts to resist overturning. The tubular posts are relatively expensive and have no protrusions or means for attaching fence wires. The steel posts are degraded over time by rusting.

Wood fence posts have a finite life due to being deteriorated by rot and insects. Further, the cost of wood fence posts remains high due to a common practice of turning a wood stock to produce a round post having a pleasing appearance and to reduce deterioration by applying a preservative.

Concrete posts currently in use are generally square in transverse cross section, heavier than round posts of equal strength, and are not efficiently manufactured. Prior apparatus and method procedures for making concrete fence posts and poles have not produced products in sufficient quantities at low enough cost to be competitive with wood and steel posts. A method of construction and apparatus to efficiently manufacture concrete posts and poles is therefore highly desirable.

Concrete fence posts made in the manner described in this invention will reduce a factory area required for manufacture, reduce the number of workers required to manufacture the concrete fence posts, and increase the number of concrete fence posts that may be produced in a day to extremely large quantities.

PREFERRED EMBODIMENT OF THE INVENTION

One preferred embodiment of this invention, includes 1) a prestressed concrete fence post assembly and method of construction; 2) a method of construction of a fence post mold assembly; 3) a method of construction of a single prestressed concrete fence post assembly; 4) a method of construction conjointly of a plurality of prestressed fence post assemblies; and 5) a carousel method of construction conjointly of a plurality of prestressed fence post assemblies.

The prestressed concrete fence post assembly includes 1) a main fence post body; 2) a prestressed tendon, cable, or wire strand member positioned centrally of the elongated tapered main fence post body; and 3) a plurality of spaced external connector grooves being parallel to each other and extended longitudinally of the main fence post body.

The main fence post body has a top surface and a bottom or anchor section to be placed within a support medium and having a tapered portion extended upwardly therefrom.

The connector grooves are adapted to receive a connector strand or tie member to attach a fence wire assembly or barbed wire strand thereto.

The method of construction of a fence post mold assembly, which will be used to produce a prestressed concrete fence post assembly, includes 1) a fence post mandrel assembly; 2) a pair of fence post mold half sections; 3) a top end plate member; and 4) a bottom end plate member.

The fence post mandrel assembly includes 1) a mandrel core body member having extended laterally and longitudinally thereof mandrel flange members; and 2) an alignment post at each opposite end thereof to provide a centering feature as will be noted.

Each of the mandrel flange members are provided with a plurality of spaced connector holes operable to be placed internally and secured to the fence post mold half sections as will be noted.

Each fence post mold half section is provided with a mold body member having support flanges secured to and extended outwardly and longitudinally of the mold body member. The support flanges have spaced anchor holes which are adjusted to be aligned with the connector holes in the mandrel flange members.

An angle iron member is welded to upper and lower ends of one fence post mold half section and having flange anchor holes thereon to receive nut and bolt members for anchoring to respective ones of the top end plate member and the bottom end plate member.

As noted in FIG. 10, the top end plate member includes 1) a plate body member having a pair of spaced resin fill holes; 2) a mandrel receiver hole to receive an upper alignment post of the fence post mandrel assembly therethrough for centering purposes; and 3) a pair of spaced connector holes.

The bottom end plate member is substantially identical to the top end plate member having a bottom plate body member having only the connector holes and a mandrel receiver hole therein.

The method steps of construction of a fence post mold assembly includes 1) connecting the fence post mold half sections to each using the nut and bolt members to clamp together, having the fence post mandrel assembly positioned centrally therebetween; 2) attaching the top and bottom end plate members by nut and bolt members to opposite ends of the fence post mold half sections; 3) pouring in a plastic resin material through the resin fill holes in the top end plate member until it is noted that an area therein between the fence post mandrel assembly and inner surfaces of the fence post mold half sections has been completely filled; 4) curing in a temperature and humidity controlled environment until the plastic resin material has been hardened; 5) removing the top and bottom end plate members; and 6) disconnecting the fence post mold half sections from each other such that the fence post mandrel assembly can be removed therefrom.

Each fence post mold half section has an inner liner formed by the plastic resin material which conforms with an outer shape and contour to be created on the prestressed concrete fence post assembly.

In the method of construction of a single prestressed concrete fence post assembly, the applicant follows a first step of connecting final end plate members to a first fence post mold half section having the angle iron support members at opposite ends thereof.

Next, the applicant places a pre-cut tendon member with opposite ends contacting and extended outwardly of the strand access slot in respective ones of the final end plate members.

Next, the other fence post mold half section is secured to the first fence post mold half section by nut and bolt members.

The applicant then utilizes a pair of anchor jaw assemblies, as noted in FIGS. 12 and 13, which are attached to respective opposite ends of the tendon members.

A portable hydraulic prestressing apparatus is connected to the upper anchor jaw assembly which, in turn, is connected to an upper end of the tendon or wire strand member. A hydraulic pressure means is used to the upper anchor jaw assembly to pull the tendon or wire strand member to apply a prestressing force thereon of a predetermined amount. An anchor nut member on the upper anchor jaw assembly is moved into an upper outer surface of the upper final end plate member to maintain the prestressing force on the tendon member.

Next, the applicant injects a special concrete grout material through an inlet spout member in the other fence post mold half section to fill areas between the fence post mold half sections and about the pre-tensioned tendon member.

Then, the applicant proceeds with a curing of the concrete grout material in the fence post mold assembly in an environment of humidity and temperature control.

After the curing has occurred, the applicant disconnects the anchor jaw assemblies and the fence post mold half sections which then allows removal of the final product being the prestressed concrete fence post assembly as noted in FIG. 1.

The fence post mold half sections can be cleansed and reassembled so that the method of producing a single prestressed concrete fence post assembly will be repeated.

The method of construction conjointly of a plurality of prestressed fence post assemblies 6 is noted in FIG. 16 whereupon the applicant provides an assembly line process consisting of 1) filling of a plurality of adjacent ones of the fence post mold assemblies; 2) an automatic station for achieving prestressing of the tendon members; 3) an assembly line method for injecting the concrete grout material within the adjacent fence post mold assemblies; and 4) moving to a curing room area of controlled temperature and humidity. After being cured, the fence post mold assemblies are disassembled, the produced prestressed concrete fence post assemblies are removed, and the respective fence post mold assemblies are moved to the station one for repeating this manufacturing process.

The carousel method of construction conjointly of a plurality of prestressed fence post assemblies involves first interconnecting of a plurality of the first fence post mold assemblies and placing a tendon or strand member within each of the fence post mold assemblies, and means for conjointly applying a prestressing force to the tendon or wire strand members.

Next, the inventor conjointly injects the concrete grout material into the respective ones of the fence post mold assemblies. After curing, the fence post mold assemblies are disassembled and the respective prestressed concrete fence post assembly removed therefrom. Then, the fence post mold assemblies are all disconnected and the prestressed concrete fence post assemblies removed therefrom. This method process can then be repeated.

OBJECTS OF THE INVENTION

One object of this invention is to produce a prestressed concrete fence post assembly including a main fence post body having a centrally positioned and longitudinally extended prestressed tendon or strand member therein.

Another object of this invention is to produce a prestressed concrete fence post assembly having a main fence post body with a plurality of parallel, spaced connector grooves that are used with a fence connector tie member to secure spaced ones of fence wire strands thereto.

One other object of this invention is to provide a method of construction of a fence post mold assembly including 1) a fence post mandrel assembly mounted between fence post mold half sections; 2) a top end plate member and a bottom end plate member are connected to respective opposite ends of the interconnected fence post mold half sections; 3) a plastic resin material is injected between the fence post mandrel assembly and the fence post mold half sections; 4) the resin material is allowed to cure; and 5) the fence post mold half sections are disconnected from each other and the fence post mandrel assembly is removed. Then, the fence post mold half sections with the respective inner plastic liner are used with final end plate members to produce the fence post mold assembly used to construct a prestressed concrete fence post assembly.

A further object of this invention is to provide a method of construction of a single prestressed concrete fence post assembly from the concrete post mold assembly involving 1) using the fence post mold assembly in an assembled condition; 2) connecting final end plate members to opposite ends of the fence post mold assembly; 3) placing a tendon member centrally and extended outwardly of each final end plate member; 4) connecting an anchor jaw assembly to each outer end of the tendon or wire strand member; 5) tensioning the tendon or wire strand member; 6) injecting a concrete grout material into the concrete post mold assembly; 7) curing of the concrete grout material; and 8) disconnecting the fence post mold assembly and the final product being the finished prestressed concrete fence post assembly is removed therefrom.

Another object of this invention is to provide a method of construction conjointly of a plurality of prestressed fence post assemblies including 1) placing a plurality of the fence post mold assemblies on a dolly to be moved in an assembly line fashion; 2) placing and prestressing tendon members in each of the fence post mold assemblies; 3) injecting each fence post mold assembly with a concrete grout material; 4) curing the concrete grout material; and 5) removing the finished product of the prestressed concrete fence post assembly.

A further object of this invention is to provide a carousel method of construction conjointly of a plurality of prestressed fence post assemblies whereupon a prestressing of tendon or wire strand members can be done conjointly as well as pouring of concrete grout material. Also, the carousel method operates to open a carousel holding structure so that the plurality of prestressed fence post assemblies can be removed therefrom and the carousel method of construction can be repeated.

One other object of this invention is to provide construction molds to produce a round, tapered prestressed concrete post or pole which is inexpensive to fabricate, durable in usage, and requires minimum personnel and factory space to produce.

One further object of this invention is to provide apparatus and method procedure steps to create a concrete fence post, pole, or tower by rapidly tensioning a centrally located high-strength steel wire cable or tendon member and retaining the tension until a concrete grout material thereabout has attained release strength.

Still, one other object of this invention is to provide equipment and procedures for producing large numbers of prestressed concrete fence posts or pole assemblies in a minimal factory area with a minimum of factory personnel.

Various other objects, advantages, and features of the invention will become apparent to those skilled in the art from the following discussion, taken in conjunction with the accompanying drawings, in which:

FIGURES OF THE INVENTION

Figure 1:
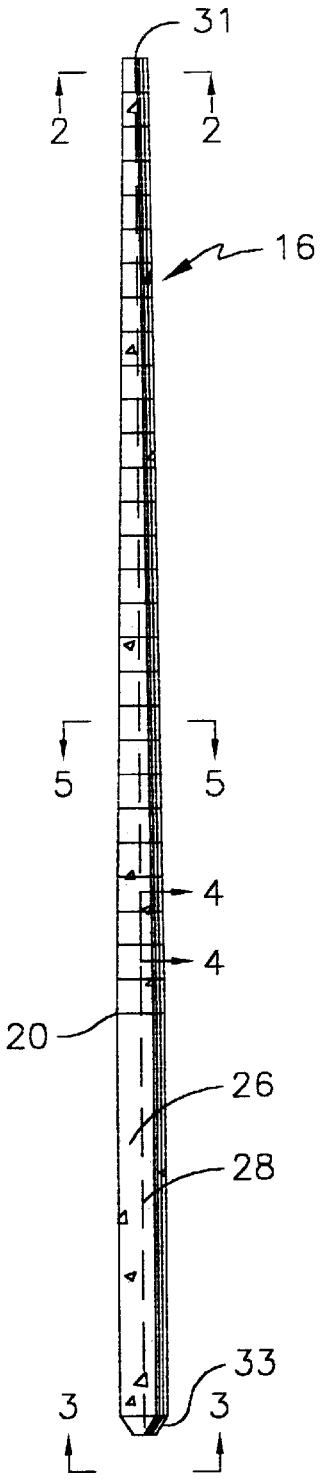
FIG. 1 is a side elevational view of a prestressed concrete fence post assembly produced by a method of construction described herein.
Figure 2:
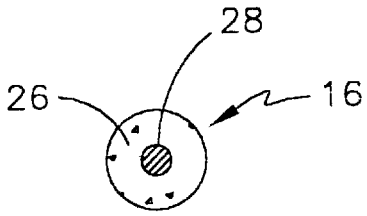
FIG. 2 is an enlarged sectional view taken along line 2—2 in FIG. 1.
Figure 3:
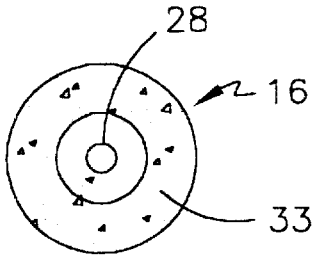
FIG. 3 is an enlarged end view taken along line 3—3 in FIG. 1.
Figure 4:
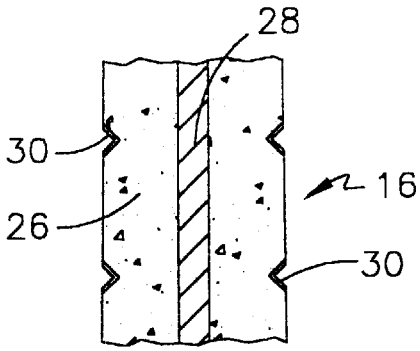
FIG. 4 is a foreshortened enlarged sectional view taken along line 4—4 in FIG. 1.
Figure 5:
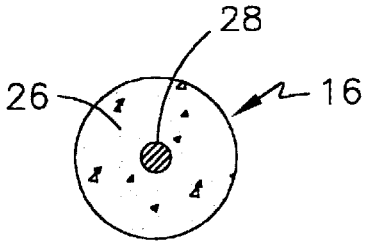
FIG. 5 is an enlarged sectional view taken along line 5—5 in FIG. 1.

The following is a discussion and description of preferred specific embodiments of the prestressed concrete fence post assembly and method of construction of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a prestressed concrete fence post assembly 16 is created by following the method of construction steps set forth in this application.

The prestressed concrete fence post assembly 16 includes 1) a main fence post body 26; 2) a prestressed tendon cable or wire strand member 28 which was previously tensioned before injecting a concrete grout material thereabout; and 3) a plurality of parallel, spaced outer connector grooves 30 operable to receive strands of fence wire being anchored thereto by known fence wire connector tie members.

The fence post body 26 has a top surface 31 and a tapered bottom section 33. A lower portion of the main fence post body 26 is of a constant diameter for a first approximately 18 inches which is to be set within a ground support area or a concrete base to provide vertical and lateral stability thereto.

The main fence post body 26 is constructed from a special high-strength cement grout material which is preferably a mixture of Portland cement, additives and properly graded sand to provide the utmost strength thereto.

In the method of construction of the prestressed concrete fence post assembly 16, we need first to provide a method of construction of a fence post mold assembly 18 which requires the use of 1) a fence post mandrel assembly 32 preferably constructed of a metal material; 2) a pair of fence post mold half sections consisting of semi-circular metal casings 34; 3) a top end plate member 36; and 4) a bottom end plate member 38.

Figure 6:
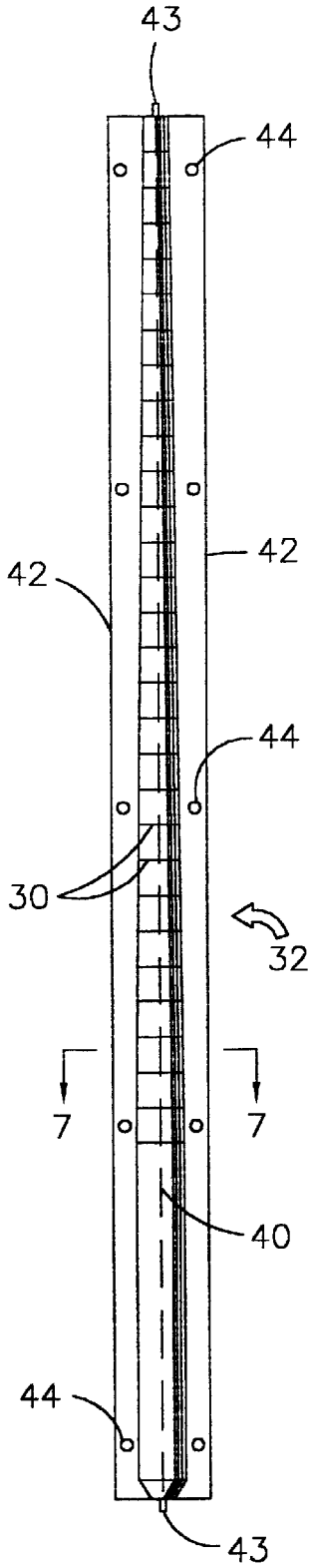
FIG. 6 is a side elevational view of a fence post mandrel assembly used to produce a fence post mold assembly of this invention.
Figure 7:
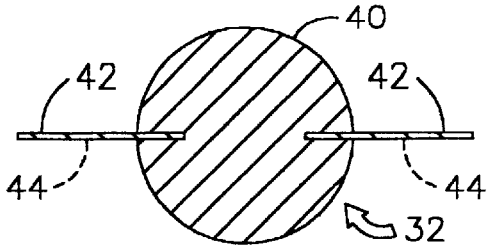
FIG. 7 is an enlarged sectional view taken along line 7—7 in FIG. 6.

As best shown in FIGS. 6 and 7, the fence post mandrel assembly 32 includes 1) a mandrel core body member 40 having mandrel flange members 42 extended laterally, outwardly, and opposite each other; and 2) alignment posts 43 extended from each opposite end of the mandrel core body member 40 for reasons to be noted.

The mandrel flange members 42 each have spaced thereon a plurality, namely five, connector holes 44 to receive nut and bolt members 50 therethrough.

The mandrel core body member 40 is tapered inwardly from a lower end portion to a top end portion to produce the previously described tapered prestressed concrete fence post assembly 16.

Figure 9:
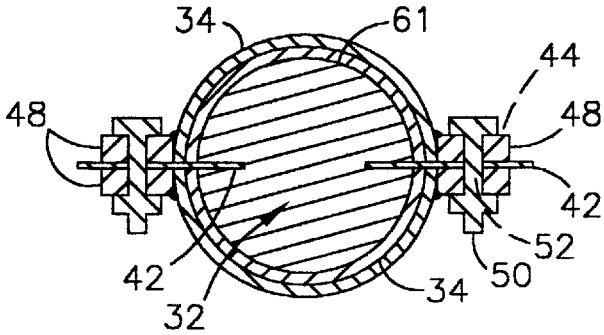
FIG. 9 is an enlarged sectional view taken along line 9—9 in FIG. 8.
Figure 8:
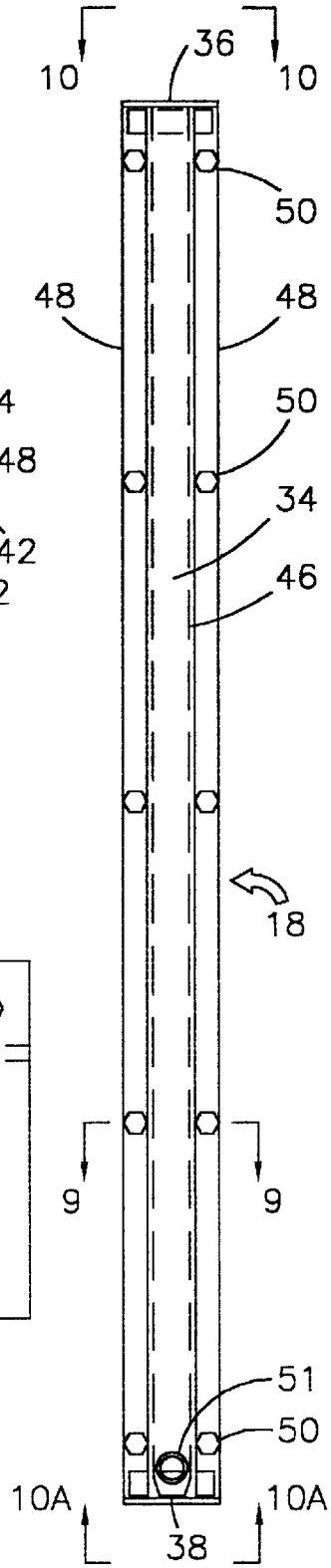
FIG. 8 is a side elevational view of a fence post mold assembly of this invention.

As best shown in FIGS. 8 and 9, each fence post mold half section 34 includes 1) a main mold body member 46; 2) welded support flanges 48 extended outwardly of the mold body member 46; and 3) nut and bolt members 50 which interconnect the fence post mold half sections 34 with the fence post mandrel assembly 32 mounted therebetween as will be noted.

Each support flange 48 is provided with spaced anchor holes 52 which are adapted to be aligned with the connector holes 44 in the mandrel flange members 42 in the assembled condition of FIG. 8.

A lowermost end of one of the fence post mold half sections 34 is provided with an inlet port 51 secured to an entrance opening 53 in a side wall in the mold body member 46. (See FIG. 13).

In the other one of the fence post mold half sections 34, there is secured at upper and lower ends, as by welding, angle iron support members 55. (See FIGS. 12 and 13). The angle iron support members 55 are provided with flange anchor holes 57 to receive nut and bolt members 50 therein when in the assembled condition.

The top end plate member 36 and bottom end plate member 38 are adapted to be interconnected to respective ones of the angle iron support members 55 when assembled.

Figure 10A:
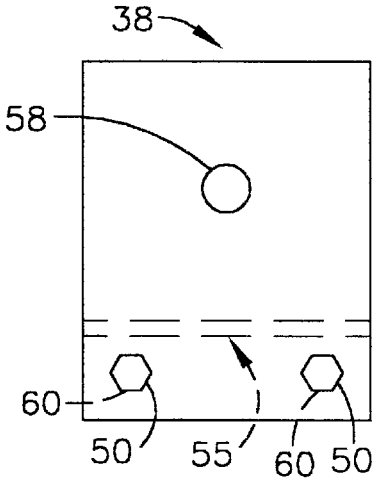
FIG. 10A is an enlarged bottom plan view taken along line 10A—10A in FIG. 8.
Figure 10:
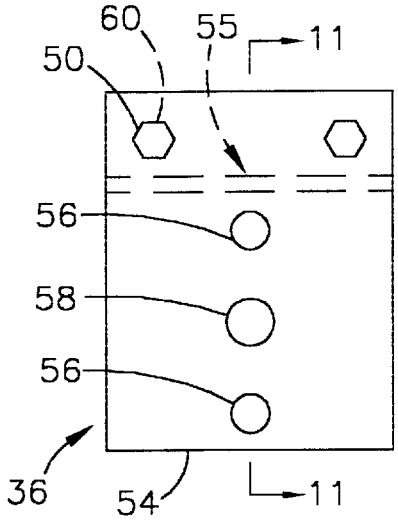
FIG. 10 is an enlarged top plan view taken along line 10—10 in FIG. 8.

As shown in FIG. 10, the top end plate member 36 includes 1) a top plate body member 54 having therein a pair of spaced resin fill holes 56; 2) a mandrel receiver hole 58; and 3) connector holes 60 used to receive nut and bolt members 50 therethrough.

In order to produce the fence post mold assembly 18, it is noted that the fence post mold half sections 34 with the fence post mandrel assembly 32 mounted therebetween are interconnected and secured through the nut and bolt members 50 inserted through the anchor holes 52 in the welded support flanges 48 and the connector holes 44 in the mandrel flange members 42 as noted in FIG. 9.

Figure 11:
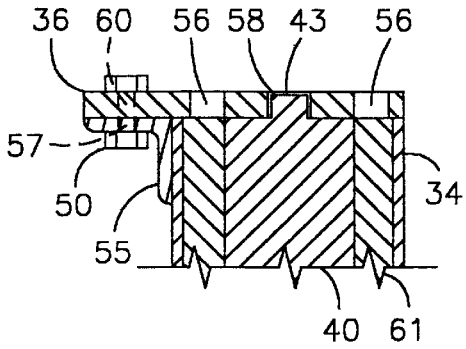
FIG. 11 is a fragmentary sectional view taken along line 11—11 in FIG. 10.

Next, the top end plate member 36 is to be mounted on the upper angle iron support member 55 and connected thereto by nut and bolt members 50 placed through the flange anchor holes 57 and the connector holes 60 in the top plate body member 54 as shown in FIG. 11.

As shown in FIG. 10A, the bottom end plate member 38 is substantially identical to the top end plate members 36 except only having the connector holes 60 therein to receive the respective nut and bolt members 50 therethrough and a mandrel receiver hole 58.

The bottom end plate member 38 is connected to a lower surface of the interconnected fence post mold half sections 34 by placing the nut and bolt members 50 through the flange anchor holes 57 in the bottom angle iron support member 55 and clamped thereagainst.

Next, the entrance opening 53 in the grout inlet port 51 is sealed to prevent the plastic resin material 61 from exiting therefrom during a plastic resin pouring process through the resin fill holes 56 in the top end plate member 36.

When in the assembled condition of the fence post mold half sections 34 having the fence post mandrel assembly 32 mounted therebetween in a centered position having the alignment posts 43 mounted in respective mandrel receiver holes 58, the next step would be pouring a resin material 61 through the upper resin fill holes 56 to fill space between the outer surface of the mandrel core body member 40 and an inner surface of the mold body member 46 of each of the fence post mold half sections 34. (See FIG. 11).

After a proper curing time, the nut and bolt members 50 in the outer mandrel flange members 42 and the support flanges 48 are removed. At this time, the nut and bolt members 50 within the connector holes 60 in the top end plate member 36 and the bottom end plate member 38 are removed. This allows the central fence post mandrel assembly 32 to be removed therefrom which leaves each fence post mold half section 34 having an interior surface with the rubber or plastic interior lining 61 shaped to a desired outer shape of the prestressed concrete fence post assembly 16 to be created therefrom. This forms the resin material liner 61 being tapered from bottom to top and having the connector grooves 30 therein.

It is noted that this method of construction of a fence post mold assembly 18 can be repeated over and over to produce a number of the fence post mold half sections 34 having the resin material liner 61 therein.

In order to construct the prestressed concrete fence post assembly 16, it is noted that the fence post mold half sections 34 are to be utilized without the fence post mandrel assembly 32, the top end plate members 36, and the bottom end plate member 38 which are replaced by final end plate members 64.

Figure 12:
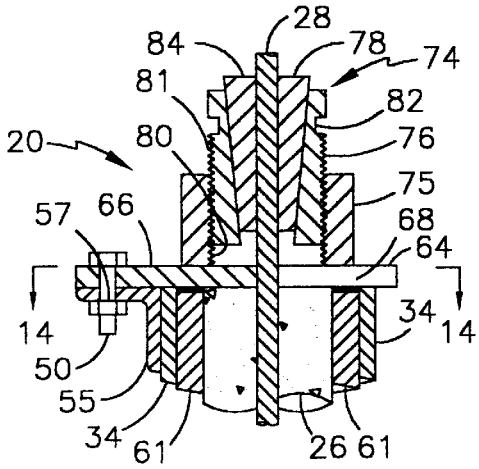
FIG. 12 is a sectional view showing a top portion of the fence post mold assembly and means for attachment to a centrally positioned tendon member.
Figure 14:
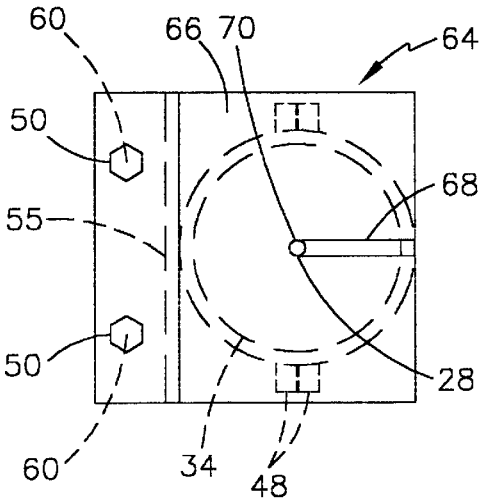
FIG. 14 is a sectional view taken along line 14—14 in FIG. 12.
Figure 13:
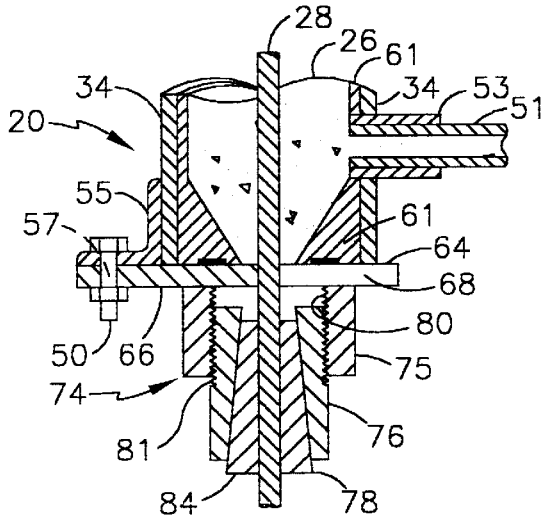
FIG. 13 is a sectional view similar to FIG. 12 showing the attachment to a lower end of the centrally positioned tendon member.

On referring to FIGS. 12–14, a method of construction of a single prestressed concrete fence post assembly 20 utilizes the previously described fence post mold half sections 34, a pair of the final end plate members 64, and a pair of anchor jaw assemblies 74 used to be interconnected to respective opposite ends of a centrally positioned prestressed tendon member 28.

As noted in FIG. 14, each final end plate members 64 includes a final plate body member 66 having base connector holes 60 and a strand access slot 68 leading from one side edge to a central portion thereof. The connector holes 60 are each adapted to receive a nut and bolt member 50 therethrough when in an assembled clamped condition.

The strand access slot 68 has a center portion 70 to receive and support a respective prestressed tendon member 28 therethrough.

As noted in FIGS. 12 and 13, we are utilizing the anchor jaw assemblies 74 which are substantially identical except for a modification at a top one thereof in FIG. 12 to receive a portable hydraulic prestressing apparatus 86 connected thereto.

As noted in FIGS. 12 and 13, each anchor jaw assembly 74 includes 1) an anchor nut member 75; 2) a center taper member 76 connected to the anchor nut member 75; and 3) an inner taper jaw member 78 mounted in the center taper member 76.

The anchor nut member 75 includes internal threads 80 to be engageable with external threads 81 on an exterior surface of the center taper member 76. The uppermost ones of the anchor jaw assembly 74, as noted in FIG. 12, are provided with an outer peripheral connector groove 82 for attachment to the portable hydraulic tensioning apparatus 86 as will be explained.

The inner taper jaw member 78 is constructed with two half sections 84 and having roughened inner surfaces that operate to grasp an outer surface of the tensioned tendon member 28.

Figure 15:
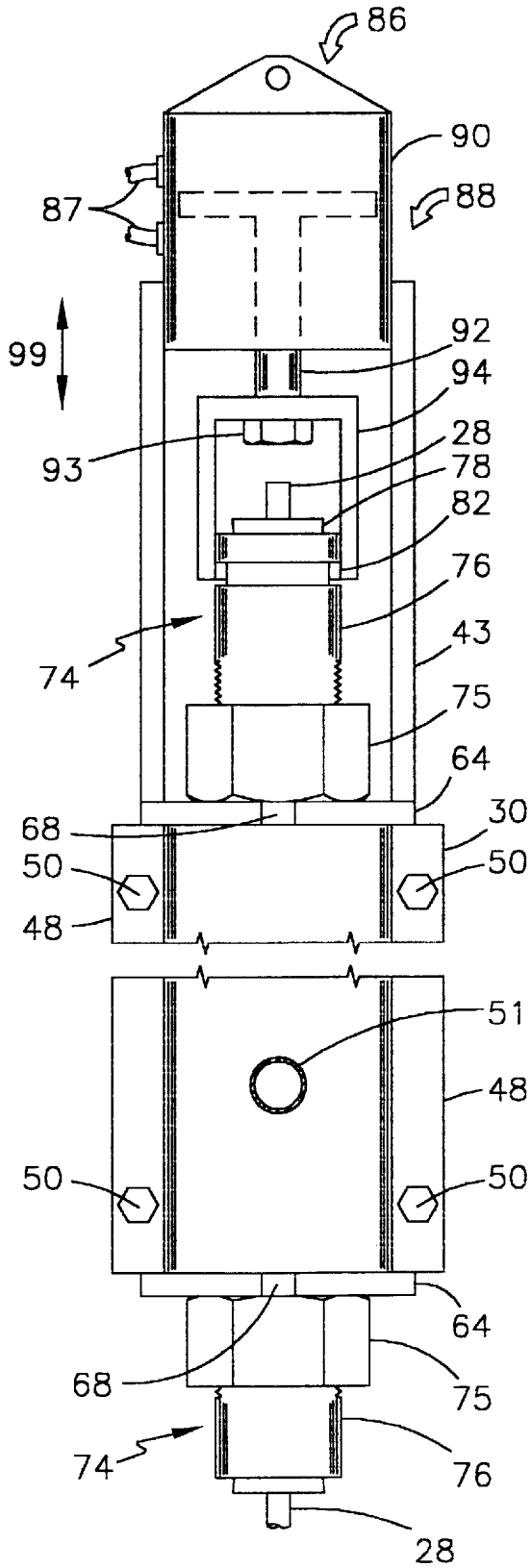
FIG. 15 is a foreshortened view of the fence post mold assembly having a portable hydraulic prestressing apparatus mounted on a top end plate member and showing attachment to an anchor jaw assembly.

As noted in FIG. 15, the portable hydraulic tensioning apparatus 86 includes hydraulic hose members 87 connected to a hydraulic piston and cylinder assembly 88. The hydraulic piston and cylinder assembly 88 includes a cylinder member 90 and a piston rod and head member 92 and a connector member 94 attached to the piston rod and head member 92 by a bolt 93. The connector member 94 consists of connector arms 95 connected to groove connector jaws 97.

As noted in FIG. 15, it is obvious that hydraulic fluid can be added or returned through the hydraulic hose members 87 on opposite sides of the piston rod and head member 92 to cause vertical movement of the connector member 94 under hydraulic fluid pressure. This vertical movement causes the interconnected tendon member 28 to move upwardly therewith as shown by an arrow 99 under a pre-determined tensioning force on the tendon member 28.

The anchor nut member 75 is threaded downwardly into contact with the adjacent final end plate member 64 to retain the tensioning force on the tendon member 28.

Figure 16:
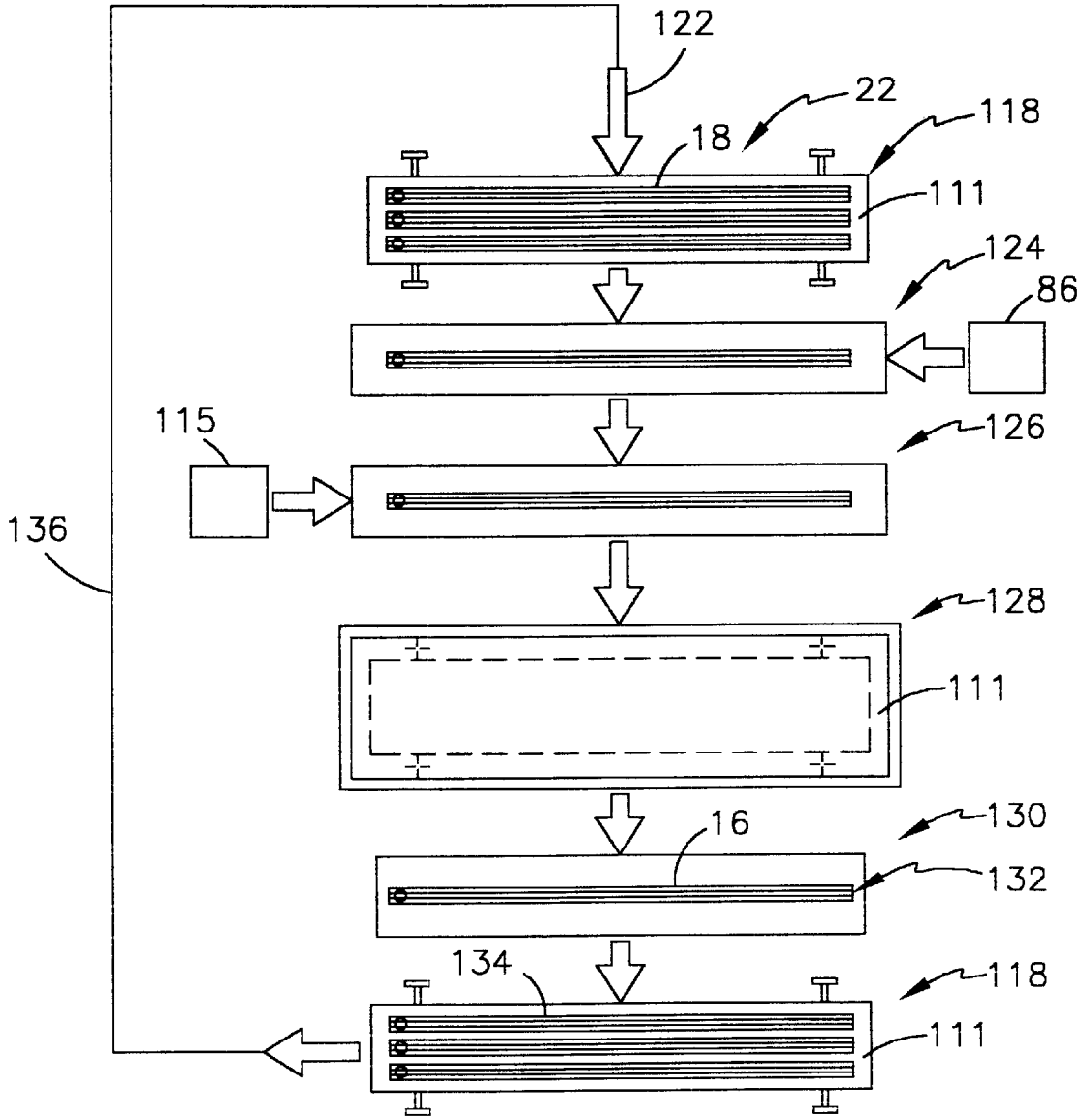
FIG. 16 is a schematic diagram of a method of construction conjointly of a plurality of prestressed fence post assemblies.

The method of construction conjointly of a plurality of prestressed fence post assemblies 22 as noted in FIG. 16, includes the use of a movable dolly assembly 111 in order to move a plurality of the fence post mold assemblies 18 to various steps of the method of construction as will be noted.

Figure 18:
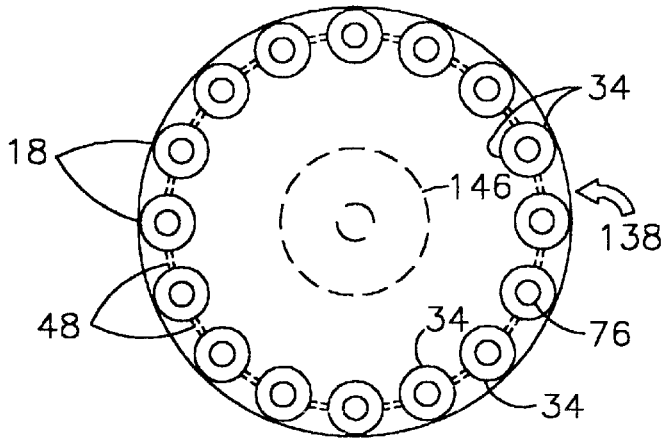
FIG. 18 is a top plan view of the carousel assembly illustrated in FIG. 17.
Figure 17:
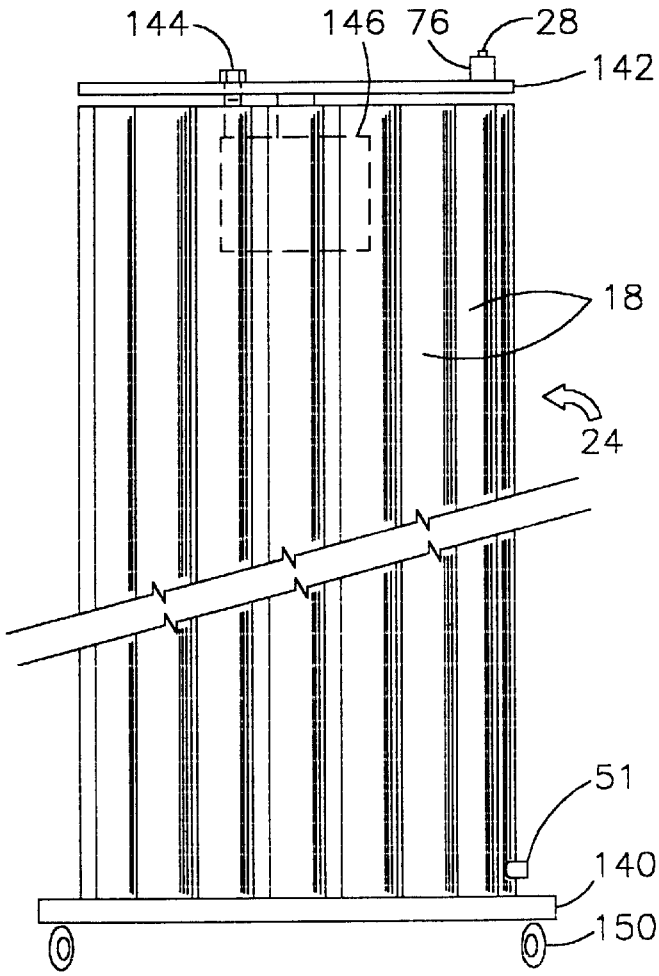
FIG. 17 is a foreshortened side elevational view of a carousel assembly used to produce conjointly of a plurality of prestressed fence post assemblies.
Figure 19:
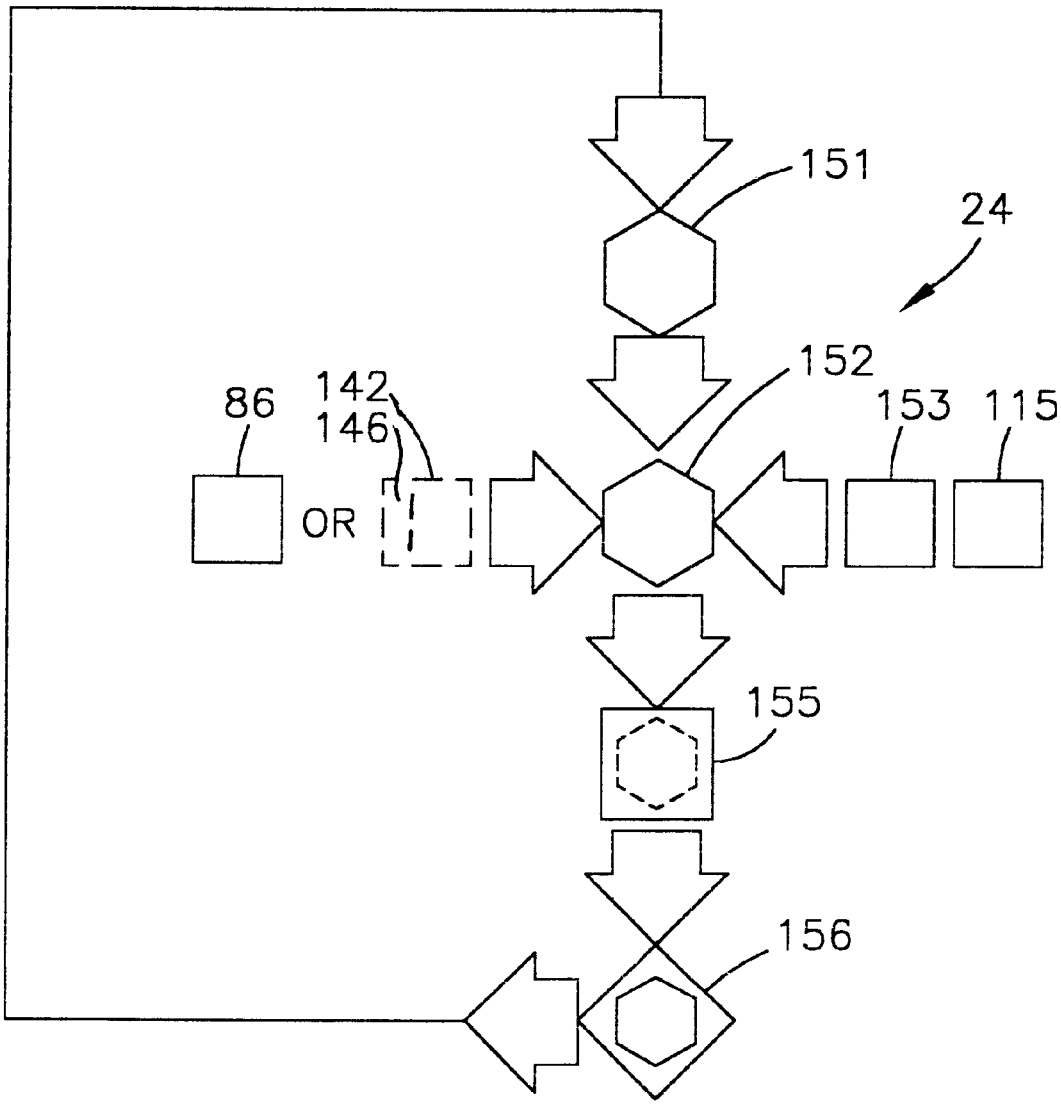
FIG. 19 is a schematic diagram utilizing a carousel method of construction conjointly of a plurality of prestressed fence post assemblies.

As noted in FIGS. 17–19, the carousel method of construction conjointly of a plurality of prestressed fence post assemblies 24 requires the use of a carousel type molding assembly 138 which includes 1) fence post mold assemblies 18 having the fence post mold half sections 34; 2) a movable dolly support assembly 140 with support casters 150; 3) a circular tensioning plate 142; 4) plate adjustment bolt members 144; and 5) a hydraulic cylinder assembly 146.

The innermost fence post half sections 34 have their support flanges 48 interconnected by welding. The other fence post half sections 34 can be clamped thereto externally of the innermost fence post half sections 34.

The circular tensioning plate 142 is operable to be interconnected to a plurality of the tendon members 28 and the entire plate can be moved by the hydraulic cylinder assembly 146 to pretension simultaneously each one of the tendon members 28 and held in an adjusted position by the plate adjustment bolt members 144. A special type of concrete pressure grout mechanism will be utilized to inject a concrete grout material into each respective one of the fence post mold assemblies 18 through their grout inlet port 51. It will be noted that the concrete grout material is allowed to cure in a controlled temperature and humidity area before the fence post mold half sections 34 are disconnected from each other and the finished prestressed concrete fence post assembly 16 can be removed therefrom.

Use and Operation of the Invention

The method of construction of the fence post mold assembly 18 with use of the fence post mandrel assembly 32 has been previously described. The fence post mold half sections 34 are utilized with the final end plate members 64, the anchor jaw assemblies 74, and the portable hydraulic tensioning apparatus 86 in the method of construction of a single prestressed concrete fence post assembly 20.

This method of construction of the single prestressed concrete fence post assembly 20 involves the steps of 1) connecting the final end plate members 64 to a first one of the fence post mold half sections 34 having the angle iron support members 55 connected thereto; 2) placing a pre-cut tendon member 28 centrally within the strand access slot 68 and supported within the center section 70 of each strand access slot 68; 3) connecting the other fence post mold half section 34 to the first fence post mold half section 34 by placing nut and bolt members 50 through the aligned anchor holes 52 in the support flanges 48; 4) connecting upper and lower ends of the prestressed tendon member 28 to the respective anchor jaw assemblies 74; 5) tensioning the tendon member 28 through use of the portable hydraulic tensioning apparatus 86 connected to the anchor jaw assembly 74 attached to the upper outer end of the tendon member 28 to provide a predetermined tensioning force thereon; 6) tightening the anchor nut member 75 on the upper anchor jaw assembly 74 to set the pre-desired tensioning force on the tendon member 28; 7) removing the portable hydraulic tensioning apparatus 86 from the upper anchor jaw assembly 74; 8) injecting the concrete grout material through the grout inlet port 51 so as to completely fill the area between the fence post mold half sections 34; 9) transporting the injected fence post mold assembly 18 into a controlled temperature and humidity curing area; 10) after the curing step is completed, prestressing the fence post assembly by rotating the top anchor nut member 75; 11) disconnecting the fence post mold half sections 34 by removing the nut and bolt members 50; 12) transporting the finished product, namely, the prestressed concrete fence post assembly 16 to a predetermined storage area; 13) cutting off outer ends of the prestressed tendon member 28 to be even with upper and lower outer ends of the main fence post body 26 of the prestressed concrete fence post assembly 16; and 14) cleaning inner surfaces of the fence post mold half sections 34 and inner surfaces of the final end plate members 64 and spraying subject inner surfaces with a mold release compound.

We can proceed with assembly of the fence post mold half sections 34 and the final end plate members 64 to proceed again with the method of construction steps stated above.

In the method of construction conjointly of a plurality of prestressed fence post assemblies 22, please refer to FIG. 16 whereupon we utilize a movable dolly assembly 111 to conjointly move, support, and convey a plurality of the fence post mold assemblies 18 thereon.

This method of construction conjointly of a plurality of prestressed fence post assemblies 22 as noted in FIG. 16 includes the steps of 1) placing 122 a plurality of the fence post mold assemblies 18 on the movable dolly assembly 118; 2) tensioning 124 each tendon member 28 in each one of the fence post mold assemblies 18 to a predetermined tensioning force by the hydraulic tensioning apparatus 86; 3) filling 126 each fence post mold assembly 18 through use of the grout injecting apparatus 115; 4) curing 128 the filled prestressed fence post mold assemblies 18 in a temperature and humidity controlled environment; 5) stripping or disassembling 130 of the fence post mold assemblies 18; 6) removing 132 a finished, cured prestressed concrete fence post assembly 16 from each fence post mold assembly 18; 7) placing 134 the fencepost mold assemblies 18 on a movable dolly assembly 111; and 8) moving and assembling 136 the fence post mold assemblies 18 to start the process steps all over again at step 1) by placing a plurality of fence post mold assemblies 18 on the movable dolly assembly 111.

These process steps can be repeated whereupon a plurality of the end product, being the prestressed concrete fence post assemblies 16, can be produced requiring a minimum amount of labor and factory space to do so.

The carousel method of construction conjointly of a plurality of prestressed fence post assemblies 24 is shown collectively in FIGS. 17, 18, and 19 with the carousel type molding assembly 138 shown in FIGS. 17 and 18.

The carousel method of construction conjointly of a plurality of prestressed fence post assemblies 24 involved the process steps of 1) interconnecting a plurality of fence post mold assemblies 18 with inner fence post mold half sections 34 interconnected to each other by welding to form the circular and, thus, carousel shape; 2) placing and tensioning each tendon member 28 conjointly and being respectively attached to the circular tensioning plate 142; 3) connecting the exterior ones of the fence post mold half sections 34 to the innermost interconnected ones of the fence post mold half sections 34; 4) injecting concrete grout material through the respective grout inlet ports 51 at the lower outer ends of the outer fence post mold half sections 34; 5) curing of the injected plurality of adjacent fence post mold assemblies 18 in a controlled temperature and humidity area; 6) releasing the circular tensioning plate member 142; 7) opening of the fence post mold assemblies 18 on removal of the outer fence post mold half sections 34; 8) removing each prestressed fence post assembly 16 therefrom and placing in a storage condition; and 9) cleaning each fence post mold assembly 18 to prepare for repeating the carousel method steps of production.

On referring to FIG. 19, the apparatus and method procedure steps for grouting, curing, and stripping for each fence post mold assembly 18 remains essentially the same for this carousel method. The factory layout, as shown in FIG. 19, identifies a carousel 151 which has been previously stripped, cleaned, and bond breaker applied, ready for use at a work station 152. A pre-cut tendon member 28 from an adjacent supply source 153 is placed within each fence post mold assembly 18 and centered in the anchor jaw assemblies 74. The outer fence post mold half sections 34 are then attached to the inner fence post mold half sections 34 with the nut and bolt members 50.

Next, the portable hydraulic tensioning apparatus 86, or the conjoint method of prestressing at the same time utilizing the circular tensioning plate 142, is accomplished by the hydraulic cylinder assembly 146.

Each of the fence post mold assemblies 18 are filled with the concrete grout material using the grout injecting apparatus 115. The carousel 151 is then moved or rolled to an adjacent curing area 155 which is temperature and humidity controlled.

The following day, the carousel 151 is rolled to a stripping area 156 where the tension in the tendon member 28 is transferred to the prestressed concrete fence post assembly 16. The prestressed concrete fence post assemblies 18 are removed from the molds and outer ends of the prestressed tendon member 28 are cut flush with the outer ends of each of the prestressed concrete fence post assemblies 16.

The fence post mold assemblies 18 are then cleaned and bond breaker applied, thus preparing the carousel for another cycle of reuse to produce the plurality conjointly of the prestressed concrete fence post assemblies 16.

The prestressed concrete fence post assemblies 16 produced by the method steps of this invention provides a structure which is sturdy in construction; economical to manufacture; readily attached to and mounted within a ground support surface or other concrete material; and having a plurality of connector grooves that can be interconnected to fence wire by the use of tie wire straps. The final product is free from deterioration and the prestressed tension member provides additional strength to prevent bending movement or breakage thereof.

The numerous method steps of producing a prestressed concrete fence post assembly are steps that are easy to follow; steps of mold assembly which are simple to achieve; presents easy means for prestressing a central tendon member within each mold assembly through use of a portable hydraulic tensioning apparatus; and being used to produce single or conjoint multiple ones of the prestressed concrete fence post assemblies; requiring a minimum amount of labor and factory space to do so.

While the invention has been described in conjunction with preferred specific embodiments thereof, it will be understood that this description is intended to illustrate and not to limit the scope of the invention, which is defined by the following claims:

I claim:

1. A method of construction of a fence post mold assembly to produce a prestressed concrete fence post assembly utilizing a pair of fence post mold half sections, connector means, a top end plate member, a bottom end plate member, and a fence post mandrel assembly, comprising the steps of:

a) clamping a fence post mandrel assembly between a pair of fence post mold half sections by a connector means;

b) securing a top end plate member and a bottom end plate member by connector means to respective upper and lower ends of a clamped said pair of said fence post mold half sections, c) inserting a plastic resin material through an opening in said top end plate member operable to create a liner about said fence post mandrel assembly being secured to inner surfaces of said fence post mold half sections;

d) removing said connector means to release said top end plate member; said bottom end plate member, and said fence post mold half sections from each other; and e) using said fence post mold half sections, each having an inner plastic liner configuration and to produce conjointly a prestressed concrete fence post assembly of this invention.

2. A method of construction of a fence post mold assembly as described in claim 1, including:

a) on securing a top end plate member and a bottom end plate member in step b), claim 1, mounting upper and lower center posts on said fence post mandrel assembly into mandrel receiver holes in said top end plate member and said bottom end plate member to achieve centering of said fence post mandrel assembly between said fence post mold half sections.

3. A method of construction of a fence post mold assembly as described in claim 1, including: a) repeating steps a) to d) in claim 1 to create other sets of said fence post mold half sections with said inner liners to produce other ones of said prestressed concrete fence post assembly of this invention.

4. A method of construction of a prestressed concrete fence post assembly from a fence post mold assembly including a pair of fence post mold half sections, a pair of final end plate members, an anchor jaw assembly, and a prestressing apparatus, comprising the steps of:

a) connecting a final end plate member to each opposite end of one of said fence post mold half sections;

b) placing a tendon member in said one of said fence post mold half sections and having outer ends of said tendon member extending outwardly of said final end plate members;

c) connecting another one of said fence post mold half sections to said one of said fence post mold half sections to form an enclosed concrete fence post molding area therebetween;

d) anchoring one end of said tendon member to an adjacent one of said final end plate members;

e) connecting an anchor jaw assembly to another end of said tendon member;

f) applying tension force against said anchor jaw assembly to apply a predetermined tensioning force to said tendon member;

g) placing concrete grout material into said enclosed molding area between said fence post mold half sections, about the tendon member, and between said final end plate members; and h) opening said fence post mold assembly and removing a cured prestressed concrete fence post assembly.

5. A method of construction as described in claim 4, a) applying a tension force in step f), claim 4, using a tensioning apparatus and hydraulic fluid pressure.

6. A method of construction as described in claim 4, a) after placing concrete grout material in step g), claim 4, moving said fence post mold assembly to a temperature and humidity controlled area for a specified time period to achieve proper curing of said concrete grout material.

7. A method of construction as described in claim 4, including:

a) on placing a tendon member as described in step b), claim 4, centering said tendon member in said final end plate members to assure that said tendon member extends longitudinally and centrally of the end product being said prestressed concrete fence post assembly.

8. A method of construction conjointly of a plurality of prestressed concrete fence post assemblies using fence post mold assemblies including a pair of fence post mold half sections each having internal plastic liners, final end plate members connectable to respective outer ends of the fence post mold half sections, tendon members, an anchor jaw assembly, and a tensioning apparatus, involving the steps of:

a) collecting a plurality of fence post mold assemblies on a movable dolly assembly for ease of conveyance to spaced factory work stations;

b) moving said movable dolly assembly to a tendon member tensioning station;

c) placing a tendon member centrally of each fence post mold assembly having respective outer ends extended outwardly of a final end plate member;

d) pretensioning each respective said tendon member to a predetermined tensioning force, e) injecting a concrete grout material into each of said fence post mold assemblies;

f) moving the said injected fence post mold assemblies to a temperature and humidity controlled work station for curing thereof;

g) releasing said tensioning force from each respective said tendon member;

h) disassembling of said fence post mold assembly; and i) removing a finished product prestressed concrete fence post assembly from each of said fence post mold assemblies.

9. A method of construction conjointly of a plurality of prestressed concrete fence post assemblies as described in claim 8, including:

a) repeating steps a) through i) in claim 8, to again create a plurality of said prestressed concrete fence post assemblies.

10. A method of construction conjointly of a plurality of prestressed concrete fence post assemblies as described in claim 8, including:

a) after removing said finished product in step i), claim 8, moving said prestressed concrete fence post assemblies to a storage area; and b) collecting said fence post mold assemblies on said movable dolly assemblies and conveying to step a), claim 8, to repeat the manufacturing steps a) to i).

11. A method of construction conjointly of a plurality of prestressed concrete fence post assemblies as described in claim 8, including:

a) spraying an internal surface of said fence post mold assemblies with a mold release compound.

12. A method of construction conjointly of a plurality of prestressed concrete fence post assemblies as described in claim 11, including:

a) assembling said fence post mold assemblies and moving to step
a) claim 8.

13. A method of construction conjointly of a plurality of a prestressed concrete fence post assembly utilizing a carousel type molding assembly having a plurality of first fence post mold half sections connected to each other to form a circular shape, a plurality of second fence post mold half sections operable to be connected to respective ones of the first fence post mold half sections, a circular tensioning plate sealing engageable with top end portions of said first and second fence post mold half sections, plate adjustment bolt members, and a hydraulic cylinder assembly to move said circular tensioning plate, comprising the steps of:

a) placing a respective tendon member centrally of each of said first fence post mold half section;

b) securing a lower end of each said tendon member against movement using an anchor jaw assembly;

c) connecting an upper end of each said tendon member to an anchor jaw assembly above a circular tensioning plate;

d) securing said second fence post mold half sections to respective ones of said first fence post mold half sections;

e) moving said circular tensioning plate to conjointly apply a predetermined tension pressure to said tendon members;

f) injecting a concrete grout material to fill each of said fence post mold assemblies;

g) moving said carousel type molding assembly to a temperature and humidity controlled curing area;

h) releasing said circular tensioning plate to transfer tension in said tendon members to compression in said concrete grout material to create a prestressed concrete fence post assembly; and i) removing said second fence post mold half sections from said first fence post mold half sections and remove the finished product being said prestressed concrete fence post assembly.

14. A method of construction conjointly of a plurality of prestressed concrete fence post assemblies utilizing a carousel type molding assembly as described in claim 13, including:

a) cutting off portions of said tendon members extended outwardly of end walls in said prestressed concrete fence post assembly.

15. A method of construction conjointly of a plurality of prestressed concrete fence post assemblies utilizing a carousel type molding assembly as described in claim 13, including:

a) cleaning said first and second fence post mold half sections; and b) applying a mold release compound to an inner surface of said first and second fence post mold half sections.

16. A method of construction conjointly of a plurality of prestressed concrete fence post assemblies utilizing a carousel type molding assembly as described in claim 15, including:

a) assembling said second fence post mold assemblies to said first fence post mold assemblies and moving to step a), claim 13.

* * * * *